US008927473B2

(12) United States Patent
Geslak et al.

(10) Patent No.: US 8,927,473 B2
(45) Date of Patent: Jan. 6, 2015

(54) COLOR INDICATION OF EFFECTIVENESS OF IMMISCIBLE LIQUID SUSPENSION

(75) Inventors: Walter M. Geslak, Belle Mead, NJ (US); Kenneth Cioletti, Wayne, NJ (US)

(73) Assignee: Walter Geslak, Belle Mead, NJ (US)

( * ) Notice: Subject to any disclaimer, the term of this patent is extended or adjusted under 35 U.S.C. 154(b) by 567 days.

(21) Appl. No.: 13/341,298

(22) Filed: Dec. 30, 2011

(65) Prior Publication Data

US 2012/0108483 A1 May 3, 2012

(51) Int. Cl.
*C11D 3/40* (2006.01)
*C11D 17/00* (2006.01)

(52) U.S. Cl.
CPC ..... *C11D 3/40* (2013.01); *C11D 17/0017* (2013.01); *C11D 17/0021* (2013.01)
USPC ..... 510/100

(58) Field of Classification Search
CPC ..... C11D 3/40; C11D 17/0017
USPC ..... 510/100
See application file for complete search history.

(56) References Cited

U.S. PATENT DOCUMENTS

| | | | | |
|---|---|---|---|---|
| 3,533,955 | A | 10/1970 | Pader et al. | |
| 6,429,177 | B1 | 8/2002 | Williams et al. | |
| 6,440,924 | B1 | 8/2002 | Jeschke et al. | |
| 6,521,581 | B1 * | 2/2003 | Hsu et al. | 510/297 |

* cited by examiner

*Primary Examiner* — Edward Cain
(74) *Attorney, Agent, or Firm* — Stanley H. Kremen

(57) ABSTRACT

A two-part liquid product, the first of which comprises a first solvent and a first dissolved dye; and the second of which comprises a second solvent and a second dissolved dye. The two solvents are immiscible. The first dye is insoluble in the second solvent, and the second dye is insoluble in the first solvent. Each dye is a different color than the other. Initially, when placed in a single container, the two parts form two separate different colored layers that do not mix. Shaking the container produces a temporary micro-emulsion. The emulsion has a new color representing the combination of the colors of the two component layers. This combination color indicates to the user that an emulsion exists and that the product is effective. The component materials are selected so as to produce a stable emulsion for between five to twenty minutes before separation.

14 Claims, No Drawings

COLOR INDICATION OF EFFECTIVENESS OF IMMISCIBLE LIQUID SUSPENSION

BACKGROUND OF THE INVENTION

Problem to be Solved

Some liquid solvents or chemical cleaning products are effective as aqueous solutions, and other products are effective as non-aqueous solutions. Dissolving and removing offending substances frequently requires the use of both product types. Often, they cannot be used together because their liquid solvents are immiscible. Yet, if they could be used together, their effect would be synergistic.

For example, surface grime might comprise multiple layers of materials, some being removable by one product (e.g., an aqueous solution), and others being removable by another product (e.g., a non-aqueous solution). The grimy substances are integrated with each other in a single homogenous mess. Often, floors covered with grime are sticky, and it is necessary to clean them. Each of the two types of cleaning products (e.g., aqueous and non-aqueous) can remove some of the grime. Together, all of the grime would dissolve. However, when used separately, each cleaning product must be applied repeatedly to effectively clean the surface. One product would remove certain substances, thereby exposing substances to be removed by the second product. However, since the grimy substances are integrated, removal of substances by the second product would then expose substances that could only be removed by the first product. Applying both cleaning products simultaneously would be more effective, thereby allowing the grime to be removed with a single application.

However, to be effective in this way, the two products need to be combined in a fine suspension. This is done by placing both liquid products into a single container and then shaking the container to form the suspension. Often, an emulsifier is added to prevent the two immiscible liquids from separating. An emulsion is formed consisting of a colloidal suspension of both liquids as minute globules. Whether or not an emulsifier is used, a temporary emulsion may be formed. Such a temporary emulsion would eventually separate into its two immiscible components. The liquid mixture would retain synergy only while emulsified. Therefore, a user would need to know when a product comprising two or more immiscible solvents is emulsified and thereby effective.

The easiest way for a user to determine whether or not the product is effective is to use a visual check. One way to do this would be to observe whether large globules appear on the surface to be cleaned. If not, the product is effective; otherwise, it is not effective. Yet, this visual test is often difficult, especially under poor lighting conditions. A better way would be to use a color indicator which changes color depending upon the degree of emulsification.

SUMMARY OF THE INVENTION

The Present Invention is a two-part liquid product. The first part comprises a first solvent and a first dissolved dye. The second part comprises a second solvent and a second dissolved dye. The two solvents are immiscible. The first dye is insoluble in the second solvent, and the second dye is insoluble in the first solvent. Each dye is a different color than the other. Initially, when placed in a single container, the two parts form separate layers, where the less dense layer rests atop the denser layer. The layers do not mix. Each layer has a different color. Addition of an emulsifier is optional, depending upon the nature of the two component parts of the product.

Shaking the container produces an emulsion of the two parts which is most likely temporary. The emulsion comprises an integrated suspension of fine globules of each of the two parts. The globules retain the color of their respective component parts. However, due to the small size and close proximity of the globules, the human eye sees a color representing the combination of the two component colors. This combination color indicates to the user that an emulsion exists and that the product is effective.

DETAILED DESCRIPTION OF THE INVENTION

The Present Invention is a two component product comprising two different immiscible solvents. A three or more component product is possible. One solvent is normally water, and the component to which that solvent belongs is an aqueous solution of hydrophobic chemicals. Dissolved in this component is a dye that gives the solution a characteristic color. Other chemicals may also be dissolved in this component. The second solvent is normally oil, and the component to which that solvent belongs is a non-aqueous solution of oleophilic chemicals. Dissolved in this second component is a dye that gives this solution a characteristic color different from the first component. The hydrophobic dye is insoluble in oil, and the oleophilic dye is insoluble in water. Agitating both components together forms an emulsion having a new color formed from mixing the two component colors. For example, if one component is yellow and the other component is blue, the color of the emulsion would be green. If one component is yellow and the other component is red, then the emulsion would be orange. If one component is red and the other blue, the emulsion would be purple. The combined color may be pre-determined using a complementary color chart. Active ingredients may be dissolved in either or both components.

The product containing the two components may be incorporated into a single container. There is no migration of the chemicals dissolved in one component into the other component upon prolonged storage. The emulsion is formed by shaking the container. Normally, the emulsion is unstable, and it will eventually separate into its component parts.

An exemplary embodiment of this product would be a stable emulsion comprising a non-aqueous phase between 20% to 30% by weight, the remainder comprising the aqueous phase. The product is normally formulated as a single phase clear micro-emulsion. A micro-emulsion is an emulsion wherein very fine globules coexist in colloidal suspension. Because the globules are so small and so close together, the micro-emulsion appears to an observer as a homogeneous liquid. When the product is diluted for use by adding one part to ten parts of water, a creamy white micro-emulsion is formed which remains stable for several hours. When the emulsion separates, a clean break does not occur. Normally, there is an upper non-aqueous phase, a lower aqueous phase, and a cloudy (milky) middle phase comprising water, non-aqueous solvent, and surfactant. A non-aqueous phase being 80% by weight was chosen for the product to provide excellent cleaning power while keeping the price within reasonable limits. The main problem is producing a product with a 20% non-aqueous phase and an 80% aqueous phase which will maintain itself in separate layers in a storage container. This product must form an unstable emulsion that separates within five to twenty minutes. At that point, the product must separate cleanly with no middle or intermediate phase. There can be no diffusion of active ingredients or dyes between the two layers.

A balance between cleaning capacity and clean phase separation can be accomplished by dissolving a combination of aliphatic and aromatic compounds in the non-aqueous phase. If a non-petroleum solvent phase is preferred, then a combination of a dibasic ester and a terpene is used. The aqueous phase may comprise buffers (carbonates, silicates, borates, phosphates, alkanolamines, etc.), chelating agents, dispersants, and surfactants. The difficulty lies with the choice of the surfactant. Most surfactants do not produce a clean separation of component phases.

The key to producing a functional product is the use of an emulsion breaker. This allows for the formation of a temporary emulsion which separates cleanly. An exemplary ingredient for use in the aqueous phase is 5%-8% ammonium chloride. Emulsion breakers may also be used in the non-aqueous phase. Exemplary compounds are low MLB (hydrophobe/lipophobe balanced) non-ionic surfactants.

An exemplary two-phase product would comprise the following:

| | |
|---|---|
| PHASE 1 | |
| d-Limonene | 50.0% |
| Dibasic Ester | 49.5% |
| Surfonic N40 | 0.5% |
| PHASE 2 | |
| Deionized Water | 96.58% |
| Sodium Citrate | 0.40% |
| Dantogard (40%) | 0.20% |
| Ammonium Chloride | 0.82% |
| Cognis APG325N | 2.00% |
| TWO-PHASE | |
| Phase 1 | 20.0% |
| Phase 2 | 80.0% |

We claim:

1. A manufactured product comprising:

a) a first component comprising a first liquid solvent that further comprises a first dye, which exhibits a first characteristic color, dissolved therein;

b) a second component comprising a second liquid solvent that further comprises a second dye, which exhibits a second characteristic color, dissolved therein;

wherein:

i) the first liquid solvent and the second liquid solvent are immiscible;

ii) the first dye is insoluble in the second liquid solvent;

iii) the second dye is insoluble in the first liquid solvent;

iv) agitation of the product causes the first and second components to form an emulsion; and v) the emulsion exhibits an apparent color that is different from the color of the first or second component, such that said apparent color is formed by combining the colors exhibited by the first and second dyes.

2. The manufactured product of claim 1 wherein the components form two stable separate layers when not emulsified, with no intermediate layer, and wherein neither solvent nor solutes from either component migrates into the other component.

3. The manufactured product of claim 2 wherein, when not emulsified and forming two separate stable layers, neither diluting the first component with additional first solvent nor diluting the second component with additional second solvent creates an intermediate layer.

4. The manufactured product of claim 1 wherein the solvents and solutes of the first and second components are selected to maintain the emulsion for a desired time period.

5. The manufactured product of claim 4 wherein the desired time period is greater than or equal to five minutes.

6. The manufactured product of claim 1 wherein either the first or second solvent is water, thereby forming an aqueous phase and a non-aqueous phase.

7. The manufactured product of claim 1 further comprising one or more surfactants.

8. The manufactured product of claim 6 wherein the non-aqueous phase further comprises an aliphatic or an aromatic compound.

9. The manufactured product of claim 6 wherein the non-aqueous phase further comprises a dibasic ester or a terpene.

10. The manufactured product of claim 6 wherein the aqueous phase further comprises a buffer, chelating agent, or dispersant.

11. The manufactured product of claim 10 wherein the buffer is selected from the group consisting of carbonates, silicates, borates, phosphates, and alkanolamines.

12. The manufactured product of claim 1 further comprising an emulsion breaker.

13. The manufactured product of claim 6 further comprising a dissolved emulsion breaker.

14. The manufactured product of claim 13 wherein the emulsion breaker that is dissolved in the aqueous phase is ammonium chloride.

* * * * *